US006619939B2

(12) United States Patent
Inoue et al.

(10) Patent No.: US 6,619,939 B2
(45) Date of Patent: Sep. 16, 2003

(54) ROTARY PUMP

(75) Inventors: Umeo Inoue, Amagasaki (JP); Satoshi Shibata, Amagasaki (JP); Hiroyuki Kishida, Amagasaki (JP)

(73) Assignee: Takuma Co., Ltd., Osaka (JP)

( * ) Notice: Subject to any disclaimer, the term of this patent is extended or adjusted under 35 U.S.C. 154(b) by 0 days.

(21) Appl. No.: 10/043,704

(22) Filed: Jan. 9, 2002

(65) Prior Publication Data

US 2003/0072667 A1 Apr. 17, 2003

(30) Foreign Application Priority Data

Oct. 12, 2001 (JP) ..... 2001-315249

(51) Int. Cl.[7] ..... F03C 2/00
(52) U.S. Cl. ..... 418/248; 418/92
(58) Field of Search ..... 418/248, 92, 62

(56) References Cited

U.S. PATENT DOCUMENTS 1,690,728 A * 11/1928 Jaworowski ..... 418/248
2,786,421 A * 3/1957 Prendergast ..... 418/248
4,664,608 A * 5/1987 Adams et al. ..... 418/63
4,737,088 A * 4/1988 Taniguchi et al. ..... 418/63
6,250,899 B1 * 6/2001 Lee et al. ..... 418/63

FOREIGN PATENT DOCUMENTS

| | | | | |
|---|---|---|---|---|
| DE | 139293 | * | 11/1934 | ..... 418/92 |
| JP | 59051182 A | * | 3/1984 | ..... F04C/02/356 |
| JP | 02140485 A | * | 5/1990 | ..... F04C/18/356 |
| JP | 03206382 A | * | 9/1991 | ..... F04C/02/356 |
| JP | 08021389 A | * | 1/1996 | ..... F04C/18/356 |

* cited by examiner

*Primary Examiner*—Thomas Denion
*Assistant Examiner*—Theresa Trieu
(74) *Attorney, Agent, or Firm*—Koda & Androlia

(57) ABSTRACT

A rotary pump including: a casing having a circular inner circumferential surface, a rotor rotating about a center of the inner circumferential surface of the casing, a partition plate installed so as to be movable in and out of the casing so that a tip end of the partition plate comes into contact with an outer circumferential surface of the rotor, a spring which drives the partition plate so that the partition plate is in constant contact with the rotor, and an intake port and a discharge port formed in the casing so as to be positioned after and before the partition plate with respect to the direction of rotation of the rotor; and the partition plate is formed with a communicating portion that communicates between the intake port side and the discharge port side.

4 Claims, 6 Drawing Sheets

ROTARY PUMP

BACKGROUND OF THE INVENTION

1. Field of the Invention

The present invention relates to a rotary pump which is used as, for example, a fuel pump of a micro-gas turbine, etc. and more specifically to an improvement in a rotary pump which is equipped in a casing with partition plates (vanes) that contact the rotor.

2. Prior Art

This type of rotary pump is disclosed in, for example, Japanese Patent Application Publication (Kokoku) No. 35-18115, Japanese Utility Model Application Laid-Open (Kokai) No. 48-113011, Japanese Patent Application Laid-Open (Kokai) No. 49-112209, Japanese Utility Model Application Laid-Open (Kokai) No. 50-115205, Japanese Patent No. 2980628 (Japanese Patent Application Laid-Open (Kokai) No. 3-206382) and Japanese Patent Application Laid-Open (Kokai) No. 8-21389.

Such rotary pumps are basically comprised of: a casing which has a circular inner circumferential surface, a rotor which rotates about the center of the inner circumferential surface of the casing as the central axis, a partition plate which is installed so as to be movable in and out of the casing with the tip end being able to come into contact with outer circumferential surface of the rotor, a spring which drives the partition plate so that the partition plate is in constant contact with the rotor, an intake port which is formed in the casing and is positioned after the partition plate with respect to the direction of rotation of the rotor, and a discharge port which is formed in the casing and is positioned before the partition plate with respect to the direction of rotation of the rotor.

In pumps of this type, when the rotor is rotated, the fluid that is to be handled is taken in through the intake port, pressurized by being constricted by the inner circumferential surface of the casing, the rotor and the partition plate, and then discharged from the discharge port. In this case, the partition plate is driven by the elastic force of the spring so that the partition plate is maintained in constant contact with the rotor, and the partition plat is moved in and out of the casing while sliding along the casing.

In the United States, diesel oil (light oil) is used as a fuel in the fuel pumps of micro-gas turbines in accordance with ASTM (US standards). In Japan, to the contrary, kerosene is used in most cases.

However, while diesel oil has a high viscosity and considerable lubricating properties, kerosene has a low viscosity and provides little lubrication.

Accordingly, in the case of rotary pumps that use a low-viscosity fuel oil such as kerosene, etc. as the fluid being handled, the fluid being handled is interposed in the areas of sliding movement between the casing and the partition plate. However, on the intake side in particular, there is no direct inflow of a compressed fluid being handled though such flow occurs on the discharge port side; as a result, wear becomes conspicuous. Consequently, the useful life of the partition plate, which is manufactured from a relatively soft material compared to the material for the casing, is short; and a drop in pump performance occurs after approximately three months (1000 hours of operation).

In some cases, gear pumps are used as fuel pumps in order to avoid this problem. However, in such cases, the increase in cost presents difficulties.

SUMMARY OF THE INVENTION

The present invention was devised in light of the above-described problems and was created in order to solve these problems. The object of the present invention is to provide a rotary pump that has an extended useful life with a simple structure and at a low cost.

The present invention is for a rotary pump that includes: a casing which has a circular inner circumferential surface, a rotor which rotates about the center of the inner circumferential surface of the casing as the central axis, a partition plate which is installed so as to be movable in and out of the casing with its tip end being able to come into contact with outer circumferential surface of the rotor, a spring which drives the partition plate so that the partition plate is in constant contact with the rotor, an intake port which is formed in the casing and is positioned after the partition plate with respect to the direction of rotation of the rotor, and a discharge port which is formed in the casing and is positioned before the partition plate with respect to the direction of rotation of the rotor; and in the rotary pump of the present invention, it is characterized in that a communicating portion that communicates between the intake port side and the discharge port side is formed in the partition plate.

When the rotor is rotated, the fluid to be handled is taken in through the intake port, pressurized as a result of being constricted by the inner circumferential surface of the casing, the rotor and the partition plate, and then discharged from the discharge port. In this case, since the partition plate is driven by the elastic force of the spring so that the partition plate is maintained in constant contact with the rotor, the partition plate is moved in and out of the casing while sliding along the casing.

The fluid being handled is interposed in the areas of sliding movement between the casing and the partition plate so that these areas are lubricated. The portions of the areas of sliding movement between the casing and partition plate that are located on the discharge port side are well lubricated because the pressurized fluid being handled flows in from the discharge port. The portions of the areas of sliding movement between the casing and partition plate that are located on the intake port side can be well lubricated also because the pressurized fluid being handled is caused to flow in through a bypass route around the partition plate and is also caused to directly flow in through the communicating portion formed in the partition plate. Accordingly, high lubrication is obtained in the areas of sliding movement between the casing and the partition plate on both the intake port side and discharge port side, thus eliminating concern about wear.

Since it is only necessary to form the communicating portion in the partition plate, the pump of the present invention can be provided at low cost by simple machining.

It is preferable that the communicating portion be a single small hole with a diameter of 0.2 to 0.5 mm. With this structure, a good flow-through action is expected in cases where the fluid being handled is a low-viscosity fuel oil such as kerosene, etc., so that smooth lubrication is possible.

It is also preferable that the communicating portion be formed so that this communicating portion communicates with the discharge port alone, only at a time other than the time when the partition plate's protruding amount is the minimum. With this structure, only at a time other than the time of minimum protrusion of the partition plate, e.g., only at the time of maximum protrusion of the partition plate, the pressurized fluid being handled on the discharge port side will pass through the communicating portion and be introduced into the areas of sliding movement on the intake port side. Accordingly, the lubrication of these areas can be quickly accomplished, and there is no hindrance of the inherent partitioning function of the partition plate.

It is further preferable that the rotor have a substantially equilateral-triangular shape that makes a sliding contact with the inner circumferential surface of the casing. Furthermore, it is also preferable that two partition plates be installed so as to face each other on a straight line which passes through the center of the rotor and that two intake ports and two discharge ports be provided. With this structure, the pump is constructed as an equilibrium type rotary pump, the pressure balance can be uniform, and the pressure cycle can be smoothed.

It is further preferable that the spring have a semi-annular shape and both ends of the spring be engaged with the base portions of the respective partition plates. With this structure, since a single spring can be used, the number of parts required is reduced, the structure is simplified, and the cost is reduced.

DETAILED DESCRIPTION OF THE INVENTION

Figure 1:
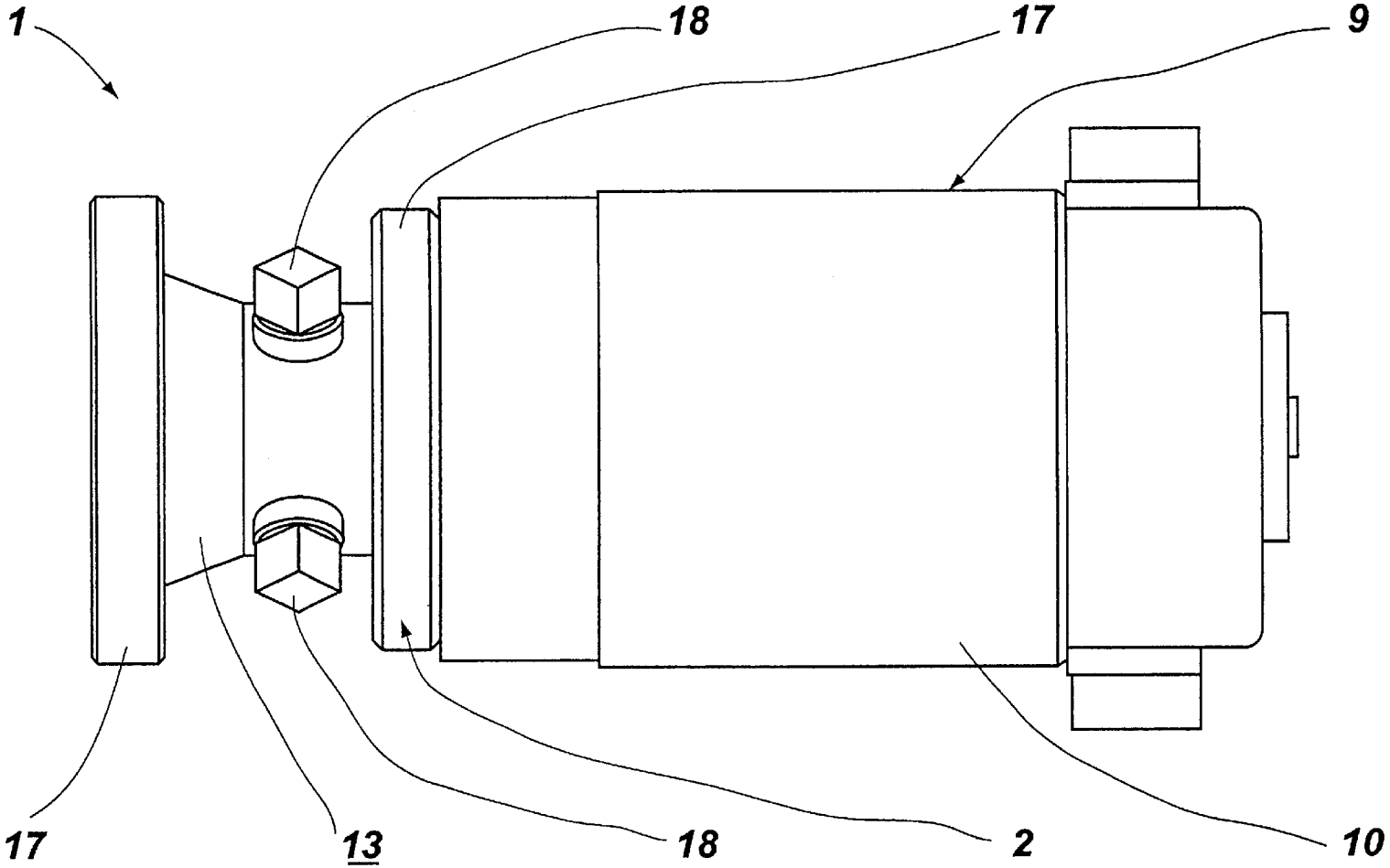
FIG. 1 is a side view of the rotary pump of the present invention.

The main portion of the rotary pump 1 comprises a casing 2, a rotor 3, partition plates 4, a spring 5, intake ports 6, discharge ports 7 and communicating portions 8.

The rotary pump 1 is directly connected to the front side (the front being on the left side in FIG. 1) of a motor 9 and is rotationally driven by this motor 9. The motor 9 is equipped with a casing 10 and a motor shaft 11.

The casing 2 has a circular inner circumferential surface 12 and is equipped with an outer casing 13 and an inner casing 14 that is accommodated inside the outer casing 13.

The outer casing 13 has a cylindrical shape, and it is comprised of an inner casing accommodating chamber 15, a coupling accommodating chamber 16, front and rear flanges 17, a plurality of plugs 18, and a sealing member accommodating groove 19.

The inner casing 14 is accommodated in the inner casing accommodating chamber 15. A coupling 21, which connects the pump shaft 20 of the rotary pump 1 and the motor shaft 11 of the motor 9, is accommodated in the coupling accommodating chamber 16. The coupling 21 has a rotation-stopping protruding portion 22, which is formed on the pump shaft 20, and a rotation-stopping recessed portion 23, which is formed in the motor shaft 11 and with which the rotation-stopping protruding portion 22 is engaged. The coupling 21 further has a bearing 24, a washer 25 and a coil spring 26. The bearing 24 is fitted over the pump shaft 20 and interposed between the outer casing 13 and the motor shaft 11. The rear-side flange 17 is fastened to the casing 10 of the motor 9 by means of bolts (not shown). Though not shown in the drawings, a cover body is fastened to the front-side flange 17 by means of bolts, and the front sides of the outer casing 13 and inner casing 14 are closed off by this cover body. In this case, a sealing member (not shown) is accommodated in the sealing member accommodating groove 16 so that a seal is formed between these elements. The plugs 18 are screwed into the outer casing 13 in a detachable manner. The plugs 18 are used to seal a lubricating oil, etc. inside the coupling accommodating chamber 16.

The inner casing 14 has a cylindrical shape and is equipped with a pump chamber 27 and a pump shaft hole 28. The front side of the pump chamber 27 is open, and a circular inner circumferential surface 12 having the center O is formed in this pump chamber 27. The pump shaft hole 28 is formed so as to communicate with the rear side so as to be concentric with the inner circumferential surface 12.

A spring accommodating groove 29 is formed between the outer casing 13 and inner casing 14, and a semi-annular filler member 30 is inserted into approximately half of this spring accommodating groove 29.

The rotor 3 is rotated about the center O of the inner circumferential surface 12 of the casing 2, thus using the center O as the central axis (pump shaft 20). This rotor 3 has a substantially equilateral-triangular shape that makes a sliding contact with the inner circumferential surface 12 of the casing 2. Each side of the rotor 3 has a circular-arc shape that protrudes outward. The respective vertices of the rotor have circular-arc shapes that are continuous to the respective sides. The rotor 3 is equipped with a pump shaft 20. The rotor 3, pump shaft 20 and inner circumferential surface 12 of the casing 2 all have the same center O, and they are thus arranged in a so-called concentric configuration.

The partition plates 4 are installed so that these partition plates 4 can move in and out of the casing 2 and so that the tip ends of these partition plates 4 can come into contact with the outer circumferential surface of the rotor 3. Two partition plates 4 are provided so that they face each other on a straight line that passes through the center O of the rotor 3. The partition plates 4 have a substantially rectangular plate shape, and spring receiving grooves 31 are formed in the base ends of the partition plates 4.

The partition plates 4 are provided in guide grooves 32 formed in the casing 2, so that these partition plates can perform a sliding movement. The tip ends of the partition plates 4 are caused to face the inner circumferential surface 12 of the casing 2 and contact the outer circumferential surface of the rotor 3, while the base ends of the partition plates 4 are caused to face the spring accommodating groove 29.

The spring 5 drives the partition plates 4 so that the partition plates 4 are maintained in constant contact with the rotor 3. This spring 5 has a semi-annular shape, and it is provided in the spring accommodating groove 29 so that both ends of the spring 5 are engaged with the spring receiving grooves 31 formed in the respective partition plates 4.

The intake ports 6 are formed in the casing 2, and they are positioned after the partition plates 4 with respect to the direction of rotation of the rotor 3. Two intake ports 6 are provided so as to correspond to the partition plates 4. Though not shown in the drawings, the respective intake ports 6 are combined together inside the cover plate, etc. and are connected to a tank in which the fluid to be handled is stored.

The discharge ports 7 are formed in the casing 2, and they are positioned before the partition plates 4 with respect to the direction of rotation of the rotor 3. Two discharge ports 7 are provided so as to correspond to the partition plates 4. Though not shown in the drawings, the respective intake ports 7 are combined together inside the cover plate, etc. and are connected to the combustion device of a micro-gas turbine, which is the supply destination of the liquid being handled.

The communicating portions 8 are formed in the partition plates 4 and communicate between the intake port 6 side and the discharge port 7 side. The communicating portions 8 are single small holes with a diameter of 0.2 mm. The communicating portions 8 are provided so as to communicate only with the discharge port 7 only at a time other than the time of minimum protrusion of the partition plates 4.

It is preferable that the small holes 8 have a diameter of ϕ 0.2 to 0.5 mm (⅕ to ½ the thickness (1 mm) of the partition plates 4) in accordance with the relationship to the viscosity of the fluid being handled. If the diameter is smaller than ϕ 0.2 mm, it becomes difficult for the fluid being handled to flow through. On the other hand, if the diameter is greater than ϕ 0.5 mm, then large quantities of the fluid being handled flow through so that the inherent function of the partition plates 4 cannot be accomplished, thus hindering the pump performance.

Furthermore, the small hole 8 is formed on the center line of each partition plate 4 in the direction of width thereof and is at a position that is separated from the tip end of the partition plate 4 by a specified distance A (1.5 mm). This specified distance A is smaller than the communicating distance B (1.7 mm) to the discharge ports 7 at the time of maximum protrusion of the partition plates 4 and is larger than the communicating distance C (0.725 mm) to the intake ports 6 at the time of maximum protrusion of the partition plates 4 and than the communicating distance D (1.03 mm) to the discharge ports 7 at the time of minimum protrusion of the partition plates 4.

Next, the operation of the above-described structure will be described.

Figure 2:
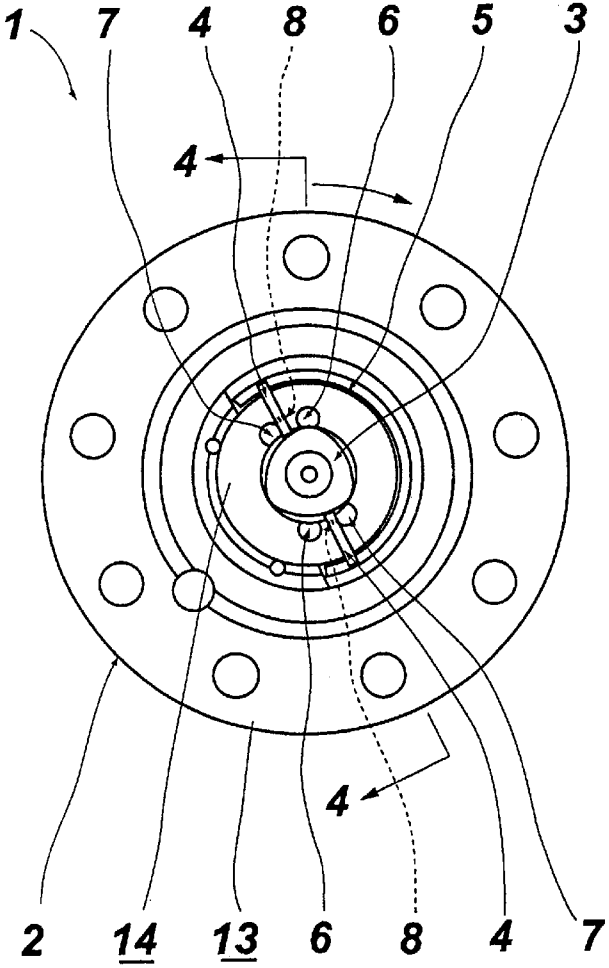
FIG. 2 is a front view of FIG. 1.
Figure 3:
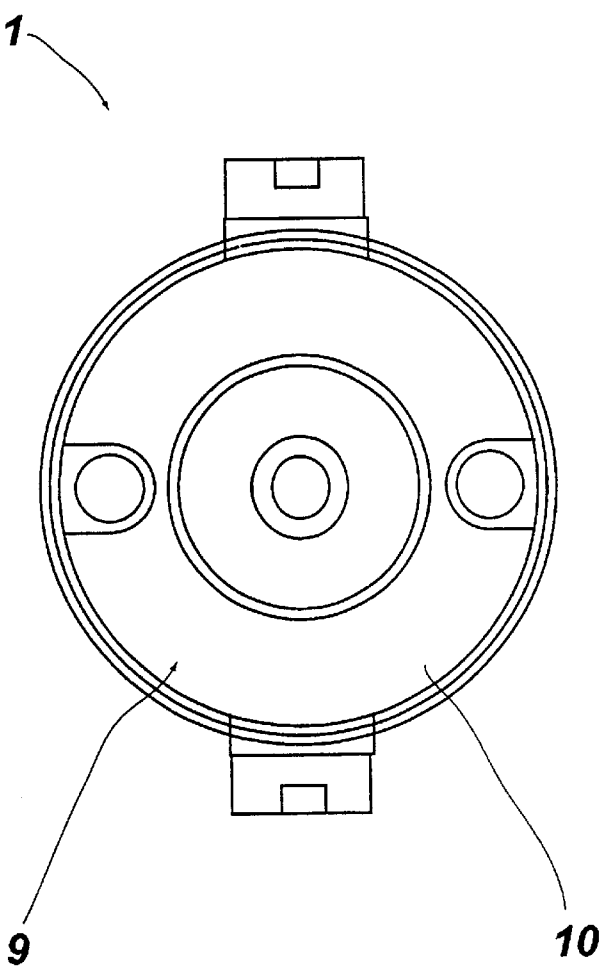
FIG. 3 is a rear view of FIG. 1.
Figure 4:
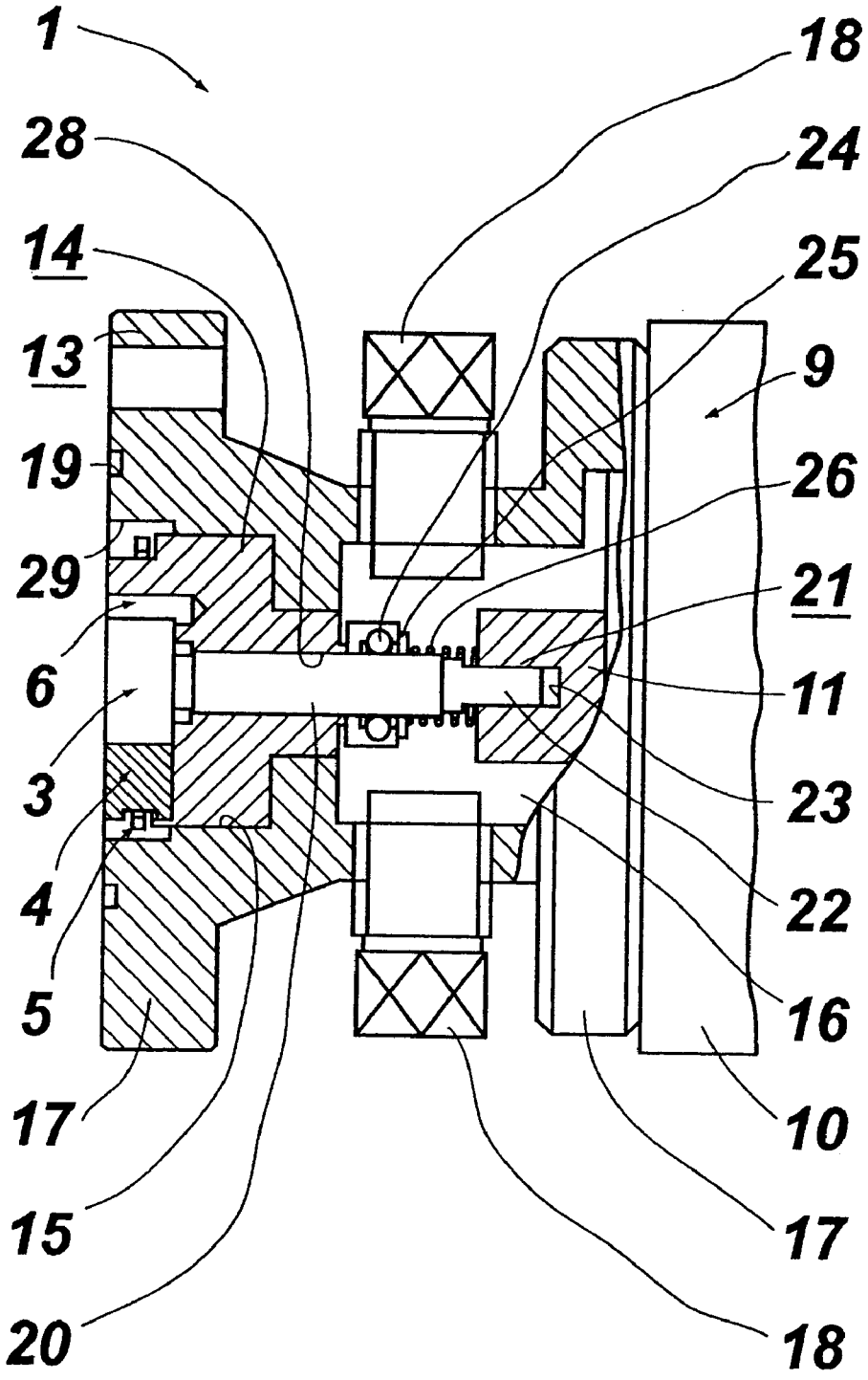
FIG. 4 is a view in the direction of arrows taken along the line 4—4 in FIG. 1.
Figure 5:
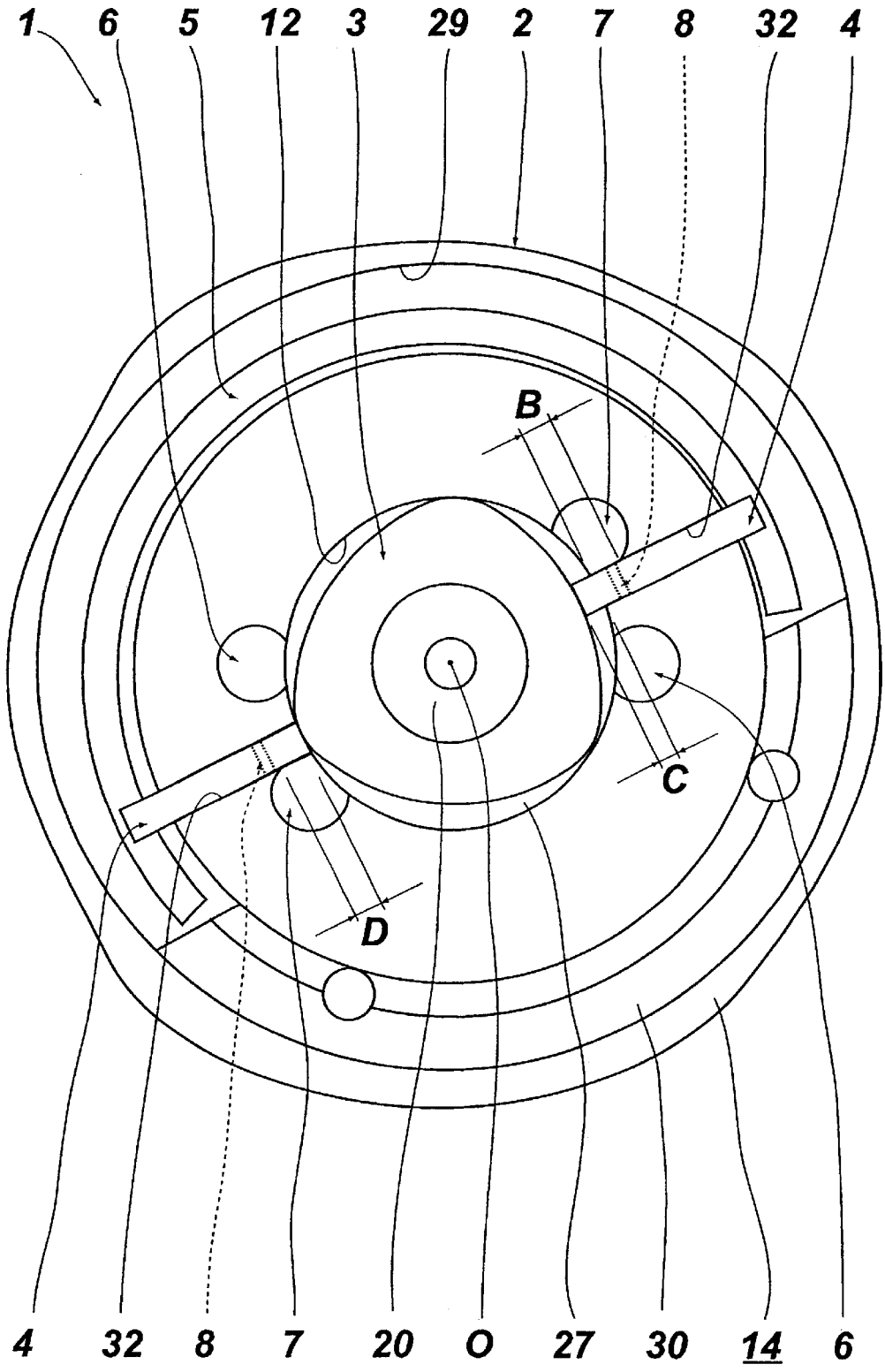
FIG. 5 is an enlarged front view.
Figure 6:
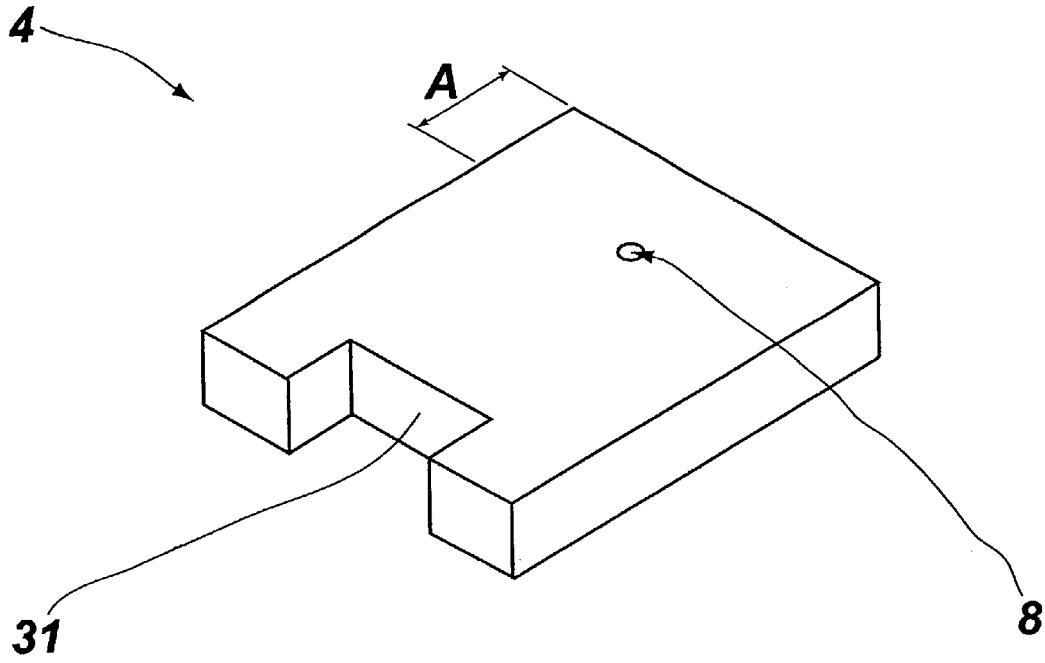
FIG. 6 is a perspective view of the partition plate.

When the rotor 3 is rotated in the clockwise direction in FIGS. 2 and 5 by the motor 9, the fluid to be handled is taken in through the intake ports 6 and is pressurized as a result of being constricted by the inner circumferential surface 12 of the casing 2, the outer circumferential surface of the rotor 3 and the partition plates 4; and then, the fluid is discharged from the discharge ports 7. In this case, the partition plates 4 are driven by the elastic force of the spring 5 so that the partition plates 4 are maintained in constant contact with the outer circumferential surface of the rotor 3, and the partition plates 4 are moved in and out while sliding through the guide grooves 32 of the casing 2.

The fluid being handled is interposed in the areas of sliding movement between the guide grooves 32 of the casing 2 and the partition plates 4 so that these areas are lubricated. In those areas of sliding movement between the guide grooves 32 and partition plates 4 that are located on the discharge ports 7 side, the pressurized fluid being handled from the discharge ports 7 is caused to flow in, and good lubrication is accomplished. In those areas of sliding movement between the guide grooves 32 and the partition plates 4 that are located on the intake ports 6 side, the pressurized fluid being handled on the side of the discharge ports 7 is caused to flow in through a bypass route around the partition plates 4 and is also caused to flow directly in through the communicating portions 8 formed in the partition plates 4, and good lubrication is accomplished.

Accordingly, high lubrication is obtained in the areas of sliding movement between the casing 2 and the partition plates 4 on both the discharge ports 7 side and the intake ports 6 side, eliminating the concern about wear.

Since it is only necessary to form the communicating portions 8 in the partition plates 4, the present invention can provide the pump at low cost by simple machining.

In order to confirm the differences in performance, the rotary pump 1 described in the above embodiment of the present invention (provided with the partition plates 4 that has the communicating portions 8), a conventional rotary pump (with no communicating portions 8 in the partition plates 4), and a substitute pump (gear pump) with comparable performance were subjected to a continuous durability test under the same conditions. In this test, the power supply voltage was doubled (to 12 V) in order to obtain a steady operating time equivalent to twice the actual operating time, and the discharge pressure was set at 230 kPa during steady operation.

Figure 7:
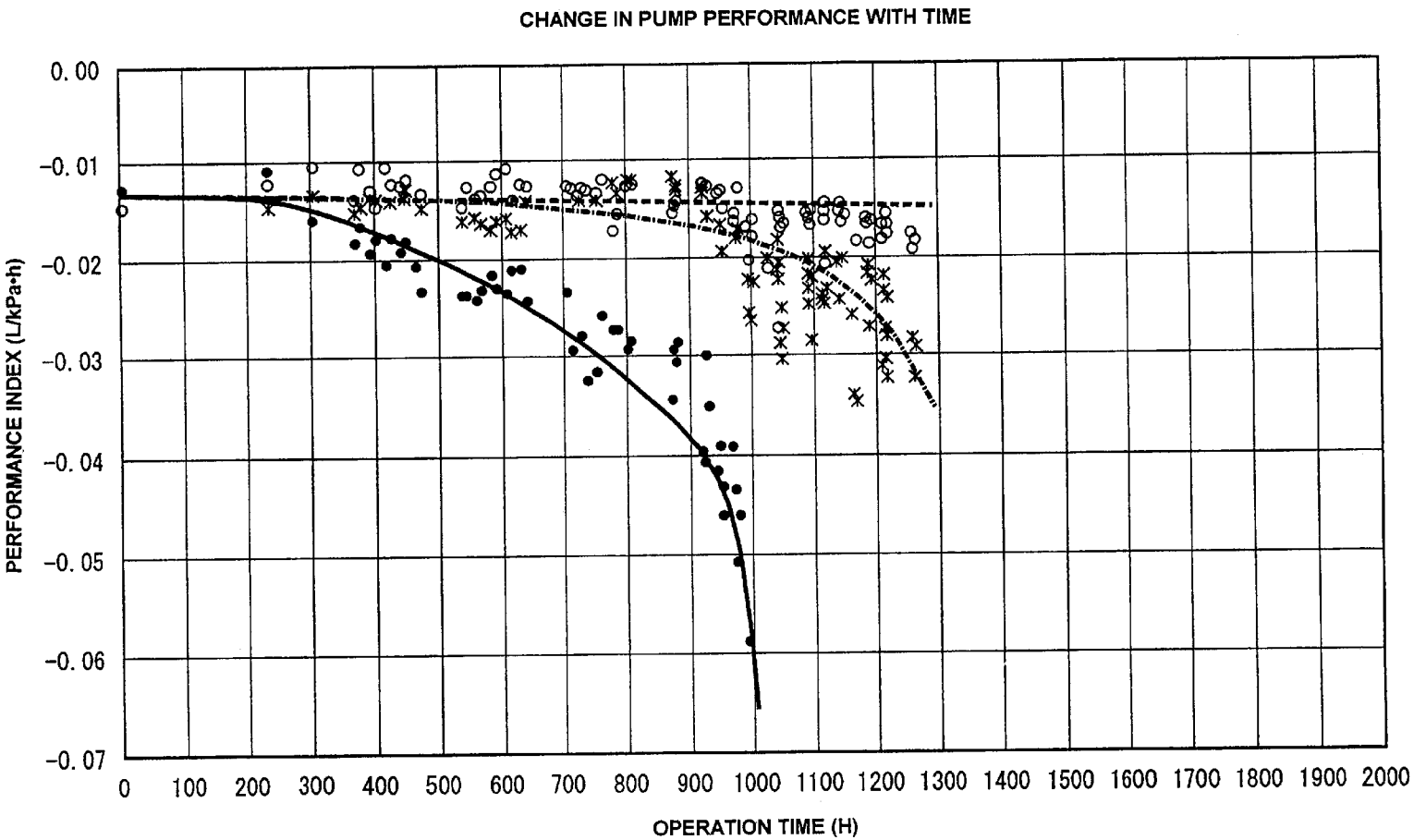
FIG. 7 is a graph that shows the variation in the pump performance over time.

The results obtained were shown in FIG. 7. In FIG. 7, the broken line indicates the rotary pump 1 of the present invention, the solid line indicates the conventional rotary pump, and the one-dot chain line indicates the substitute pump.

The rotary pump 1 of the present invention shows no deterioration in performance even after the operating time of 1700 h (equivalent to 3400 h). On the other hand, the conventional rotary pump began to show a gradual deterioration from around 300 h (equivalent to 600 h) and became unusable at 800 h (equivalent to 1600 h). Meanwhile, the substitute gear pump also began to show deterioration in performance after 1000 h (equivalent to 2000 h) and became unstable.

Thus, it is confirmed that the rotary pump 1 of the present invention provides improved lubrication compared to the conventional rotary pump and exhibits performance comparable to that of the substitute pump.

In the above embodiment, the rotary pump 1 is for a low-viscosity fuel oil such as kerosene, etc. However, the present invention is not limited to this; and it can be used also for, for instance, a high-viscosity fuel oil such as diesel oil, etc.

In the above embodiment, the rotor 3 has a substantially equilateral-triangular shape. However, the present invention is not limited to this; and the rotor 3 can have, for instance, a circular or elliptical shape, etc.

In the above embodiment, two partition plates 4, two intake ports 6 and two discharge ports 7 are provided. However, the present invention is not limited to this; and it is possible to install only one, for instance, of each of these elements.

In the above embodiment, the communicating portions 8 are small holes. However, the present invention is not limited to this; and the communicating portions can be, for instance, slits and the line.

In the above embodiment, a single communicating portion 8 is formed in each partition plate 4. However, the present invention is not limited to this; and, for instance, a plurality of communicating portions can be formed in each partition plate.

The present invention, as seen from the above, provides the following superior advantages:

(1) Since the pump is constructed from a casing, rotor, partition plates, spring, intake ports, discharge ports and communicating portions, and especially since the communicating portions that communicate between the intake port side and discharge port side of each partition plate are formed, the lubrication of the areas of sliding movement between the casing and the partition plates is improved, and the useful life of the pump is extended simply and inexpensively.

(2) Since the communicating portions that communicate between the intake port side and discharge port side are merely formed in the partition plates, the present invention is easily applicable to existing pumps.

What is claimed is:

1. A rotary pump comprising:

a casing which has a circular inner circumferential surface, a rotor which rotates about a center of said inner circumferential surface of said casing as a central axis, a partition plate which is installed so as to be movable in and out of said casing so that a tip end of said partition plate comes into contact with an outer circumferential surface of said rotor, a spring which drives said partition plate so that said partition plate is in constant contact with said rotor, an intake port formed in said casing, said intake port being positioned after said partition plate with respect to a direction of rotation of said rotor, and a discharge port formed in said casing, said discharge port being positioned before said partition plate with respect to said direction of rotation of said rotor, wherein said pump is characterized in that a communicating portion tat communicates between an intake port side and an discharge port side is provided in said partition plate, and said rotor has a substantially equilateral-triangular shape that makes a sliding contact with said inner circumferential surface of said casing inner, two of said partition plates are provided so as to face each other on a straight line tat passes through a center of said rotor, and two of said intake ports and two said discharge ports are provided.

2. The rotary pump according to claim 1, wherein said communicating portion is a single small hole with a diameter of 0.2 to 0.5 mm.

3. The rotary pump according to claim 1, wherein said communicating portion is formed so as to communicate only with said discharge port only at a time other than a time of minimum protrusion of said partition plate.

4. The rotary pump according to claim 1, wherein said spring has a semi-annular shape, and both ends of said spring are engaged with base portions of said partition plates.

* * * * *